US010767131B2

(12) United States Patent
Albuzat et al.

(10) Patent No.: US 10,767,131 B2
(45) Date of Patent: Sep. 8, 2020

(54) MOTOR FUEL FORMULATION

(71) Applicant: Swift Fuels, LLC, West Lafayette, IN (US)

(72) Inventors: Thomas Albuzat, Homburg (DE); Chris D'Acosta, West Lafayette, IN (US)

(73) Assignee: SWIFT FUELS, LLC, West Lafayette, IN (US)

( * ) Notice: Subject to any disclaimer, the term of this patent is extended or adjusted under 35 U.S.C. 154(b) by 0 days.

(21) Appl. No.: 15/940,012

(22) Filed: Mar. 29, 2018

(65) Prior Publication Data

US 2019/0106644 A1 Apr. 11, 2019

Related U.S. Application Data

(63) Continuation of application No. 14/645,107, filed on Mar. 11, 2015, now abandoned.

(60) Provisional application No. 61/950,993, filed on Mar. 11, 2014.

(51) Int. Cl.
*C10L 1/04* (2006.01)
*C10L 10/10* (2006.01)

(52) U.S. Cl.
CPC ..... *C10L 10/10* (2013.01); *C10L 1/04* (2013.01); *C10L 2270/023* (2013.01); *C10L 2270/04* (2013.01)

(58) Field of Classification Search
CPC ..... C10L 2270/04; C10L 2270/023
USPC ..... 585/14; 44/300; 208/15–17
See application file for complete search history.

(56) References Cited

U.S. PATENT DOCUMENTS

| | | | | |
|---|---|---|---|---|
| 1,315,585 | A | 9/1919 | Weizmann | |
| 1,713,589 | A | 5/1929 | Bereslavsky | |
| 2,401,983 | A | 6/1946 | Stanly et al. | |
| 2,413,262 | A | 12/1946 | Stirton | |
| 2,422,674 | A | 6/1947 | Haensel et al. | |
| 2,425,096 | A | 8/1947 | Ipatieff et al. | |
| 2,506,539 | A | 5/1950 | Boerdman | |
| 2,593,561 | A | 4/1952 | Herbst et al. | |
| 2,917,561 | A | 12/1959 | Eby | |
| 3,201,485 | A | 8/1965 | Kovach | |
| 3,267,165 | A | 8/1966 | Kimble et al. | |
| 3,301,912 | A | 1/1967 | Hwang et al. | |
| 3,946,079 | A | 3/1976 | Mizutani et al. | |
| 4,006,149 | A | 2/1977 | Bonnemann et al. | |
| 4,300,009 | A | 11/1981 | Haag et al. | |
| 4,368,056 | A | 1/1983 | Pierce et al. | |
| 4,398,920 | A | 8/1983 | Guibet et al. | |
| 4,398,921 | A | 8/1983 | Rifkin et al. | |
| 5,063,156 | A | 11/1991 | Glassner et al. | |
| 5,087,781 | A | 2/1992 | Schutz et al. | |
| 5,189,232 | A * | 2/1993 | Shabtai | C10L 1/04585/14 |
| 6,271,433 | B1 | 8/2001 | Keady et al. | |
| 6,353,143 | B1 | 3/2002 | Fang et al. | |
| 6,555,350 | B2 | 4/2003 | Ahring et al. | |
| 6,648,931 | B1 | 11/2003 | Rao | |
| 6,908,591 | B2 | 6/2005 | MacPhee et al. | |
| 6,982,155 | B1 | 1/2006 | Fukuda et al. | |
| 6,991,810 | B1 | 1/2006 | Grundy et al. | |
| 6,998,050 | B2 | 2/2006 | Nakajoh et al. | |
| 7,141,083 | B2 | 11/2006 | Jordan | |
| 7,462,207 | B2 | 12/2008 | Clark | |
| 7,834,230 | B2 | 11/2010 | Fujimoto et al. | |
| 8,324,437 | B2 | 12/2012 | Hemighaus et al. | |
| 8,344,193 | B2 | 1/2013 | Rusek et al. | |
| 8,628,594 | B1 * | 1/2014 | Braly | C10L 1/06 44/426 |
| 8,801,919 | B2 | 8/2014 | Viljoen et al. | |
| 9,035,113 | B2 | 5/2015 | Lopez et al. | |
| 9,169,451 | B2 * | 10/2015 | Cannella | C10L 1/04 |
| 2002/0045785 | A1 | 4/2002 | Bazzani et al. | |
| 2002/0055663 | A1 | 5/2002 | Barnes et al. | |
| 2003/0040650 | A1 | 2/2003 | Butler et al. | |
| 2003/0183554 | A1 | 10/2003 | Bazzani et al. | |
| 2004/0020106 | A1 | 2/2004 | Tack et al. | |
| 2005/0000855 | A1 | 1/2005 | Farrell et al. | |
| 2006/0051848 | A1 | 3/2006 | Nishio et al. | |
| 2007/0135318 | A1 | 6/2007 | Singh et al. | |

(Continued)

FOREIGN PATENT DOCUMENTS

| | | |
|---|---|---|
| EP | 0460957 | 11/1991 |
| EP | 0526129 | 2/1993 |

(Continued)

OTHER PUBLICATIONS

Bird, C.W., Transition Metal Intermediates in Organic Syntehsis, New York, Lond: Academic Press, 1967, pp. 1-29.
Colket et al., Development of an Experimental Database and Kinetic Models for Surrogate Jet Fuels, Mar. 1, 2007, American Institute of Aeronautics, pp. 1-21.
English Abstract for JP 57145181.
Englsih Abstract for JP 62-278989.
International Search Report and Written Opinion issued in PCT/US2014/036646, dated Sep. 17, 2014 16 pgs.
International Search Report and Written Opinion dated Oct. 19, 2011, in corresponding International Application No. PCT/US2011/037505.
International Search Report dated Nov. 8, 2011 in corresponding International Application No. PCT/US2011/026948.
Roubaud et al, Oxidation and Combustion of Low Alkylbenzenes at High Pressure, 2000, Combustion and Flame 121:535-541.
Zaldivar et al. Abstract, Applied Microbiology Biotechnology (2001), pp. 17-34, vol. 56.

*Primary Examiner* — Ellen M McAvoy
(74) *Attorney, Agent, or Firm* — Woodard, Emhardt, Henry, Reeves & Wagner, LLP

(57) ABSTRACT

Described are preferred compositions for a motor fuel. Such motor fuels may be particularly well suited for use in the motor of an aircraft. In particular, compositions of the present disclosure may comprise alicyclic alkanes, straight or branched chain alkanes, and aromatics. In a preferred embodiment, the fuel comprises cyclopentane, isooctane, and one or more aromatics selected from xylene, toluene, and trimethylbenzenes. The present disclosure describes a full spectrum of unleaded fuels with various motor octane (MON) values to address a wide range of aviation fuel needs in the global marketplace.

7 Claims, No Drawings

(56) References Cited

U.S. PATENT DOCUMENTS

2007/0175088 A1 8/2007 Selkirk
2008/0168706 A1 7/2008 Rusek et al.
2008/0172931 A1* 7/2008 Bazzani ..... C10L 1/023 44/447
2008/0244961 A1 10/2008 Rusek et al.
2008/0244962 A1 10/2008 Abhari et al.
2009/0000185 A1 1/2009 Aulich et al.
2009/0013591 A1 1/2009 Braden et al.
2009/0117619 A1 5/2009 Hutcheson et al.
2009/0203098 A1 8/2009 Verser
2010/0077655 A1* 4/2010 Bauldreay ..... C10L 1/02 44/437
2010/0268005 A1 10/2010 Rusek et al.
2010/0298615 A1 11/2010 Rusek et al.
2011/0005190 A1* 1/2011 Bauldreay ..... C10L 1/04 60/39.461
2011/0088311 A1* 4/2011 Bower ..... C10L 1/026 44/367
2012/0029251 A1* 2/2012 Hemighaus ..... C10L 1/04 585/14
2012/0110900 A1 6/2012 Tsai et al.
2012/0144902 A1* 6/2012 Torres-Ordonez ..... C10L 1/023 73/61.41
2013/0199481 A1* 8/2013 Rantanen-Kolehmainen ..... C10L 1/1852 123/1 A
2014/0116367 A1* 5/2014 Braly ..... C10L 1/14 123/1 A
2015/0007489 A1* 1/2015 Aubry ..... C10L 1/023 44/451
2016/0032204 A1* 2/2016 Nousiainen ..... C10L 1/023 44/449
2016/0046872 A1* 2/2016 Lindberg ..... C10L 1/026 585/13

FOREIGN PATENT DOCUMENTS

JP 57145181 9/1982
JP 62-278989 12/1987
WO WO 1998/51813 11/1998
WO WO 2008/013922 A1 1/2008
WO WO 2009/152495 A2 12/2009

* cited by examiner

MOTOR FUEL FORMULATION

BACKGROUND

Motor fuels are used in a variety of systems. In the broadest sense, a motor fuel is one which is used in piston or turbine engines. The present invention is directed to fuels for a variety of spark-ignited combustion engines including higher rpm engines as well as piston engine useful in ground vehicles and/or certain aircraft engines and/or unmanned aviation vehicles (UAV). Typically, ground vehicles can use relatively lower octane fuels, while aircraft require higher octane fuels. A basic determinant as to the choice of fuels is the octane rating of the fuel compared to the compression of the engine. For example, higher compression engines generally require higher octane fuels. Another determinant is the fuel's burn speed in the combustion chamber. Higher rpm engines tend to favor faster burning fuels in a controlled combustion process (i.e. without exploding) to prevent engine knocking. So, many engine designs have evolved calling for specialized fuels tailored to unique needs balancing engine performance between higher octane vs. faster burn speed.

A particular aspect of the present invention is to provide formulations which are useful as piston engine fuels, and are particularly suited for use in automobiles, high rpm auto racing engines as well as aviation gasoline applications. Aviation gasoline has a number of special requirements as compared to ground vehicle gasoline. Aviation gasoline (called "avgas") is an aviation fuel used in spark-ignited (reciprocating) piston engines to propel aircraft. Avgas is distinguished from mogas (motor gasoline), which is the everyday gasoline used in motor vehicles and some light aircraft. Most grades of avgas have historically contained tetraethyl lead (TEL), a toxic substance used to prevent engine knocking (detonation).

This invention produces an unleaded grade of gasoline with fuel properties that meet the minimum power rating (motor octane number), appropriate combustion anti-knocking (detonation suppression), volatility (vapor pressure), and related criteria for piston engine aircraft and thereby complies with all current requirements of ASTM 4814, ASTM D910 and ASTM D7547 fuel. The inventive fuels allow a range of automobiles and piston engine aircraft, including those with higher rpm and high-compression engines, to perform effectively to manufacturer requirements.

Aviation gasoline must meet the power demands for aircraft engines. The motor octane number, or MON, is a standard measure of the performance of an aviation fuel. The higher the MON, the more compression the fuel can withstand before detonating. In broad terms, fuels with a higher motor octane rating are most useful in high-compression engines that generally have higher performance.

The MON is a measure of how the fuel behaves when under load (stress). ASTM test method 2700 describes MON testing using a test engine with a preheated fuel mixture, 900 rpm engine speed, and variable ignition timing to stress the fuel's knock resistance. The MON of the aviation gasoline fuel can be used as a guide to the amount of knock-limiting power that may be obtained in a full-scale engine under take-off, climb and cruise conditions.

Another particular issue with avgas is its ability to start reliably under a wide range of altitude and climate conditions. Avgas needs to have a lower and more uniform vapor pressure than automotive gasoline so it remains in the liquid state despite the reduced atmospheric pressure at high altitude, thus preventing vapor lock. The ability of an aviation gasoline to satisfy this requirement may be assessed based on the Reid Vapor Pressure (RVP). A typical requirement for avgas is that it have an RVP of 38-49 kPa at 37.8° C., as determined in accordance with ASTM D5191.

Avgas must also be highly insoluble in water. Water dissolved in aviation fuels can cause serious problems, particularly at altitude. As the temperature lowers, the dissolved water becomes free water. This then poses a problem if ice crystals form, clogging filters and other small orifices, which can result in engine failure. Accordingly, alcohol components are generally not used in aviation fuels due to their tendency to be water soluble.

In light of this background, there remains a need for additional and/or improved fuel compositions.

SUMMARY

In one aspect, the present invention provides for an improved fuel. For example, compositions of the present invention with a high motor octane number (MON) and ideal boiling point characteristics (impacting fuel stability, cold starting features, etc.) may be useful as aviation fuel for many types of aircraft engines including high-performance engines and also legacy aircraft.

In another aspect, the present invention provides for an improved fuel that contains a minimal amount of lead compounds to achieve its optimal detonation suppression characteristics. For example, certain compositions of the present invention do not include the use of any tetraethyl lead or any ethylene dibromide to scavenge for the lead in the aircraft fuel system.

In still another aspect, the present invention provides for an improved fuel that meets or exceeds one or more requirements of ASTM D4814, and/or ASTM D910 and/or ASTM D7719 and/or ASTM D7547.

In yet another aspect, the present invention provides for an improved fuel comprising alicyclic alkanes, linear or branched alkanes, and aromatics. For example, in a preferred embodiment the fuel comprises cyclopentane, isooctane, and xylene. In a most preferred embodiment, meta-xylene is employed as the isomer of xylene.

Additional embodiments of the invention, as well as features and advantages thereof, will be apparent from the descriptions herein.

DETAILED DESCRIPTION

For the purposes of promoting an understanding of the principles of the invention, reference will now be made to certain embodiments and specific language will be used to describe the same. It will nevertheless be understood that no limitation of the scope of the invention is thereby intended, such alterations and further modifications, and such further applications of the principles of the invention as described herein being contemplated as would normally occur to one skilled in the art to which the invention relates.

As discussed above, aspects of the present invention relate to compositions of fuel. More particularly, aspects of the present invention may be particularly applicable to fuel compositions used for aircraft, often called aviation gasoline or avgas. ASTM specification D7719 describes a fuel specification for aviation fuel. ASTM D4814 for auto gasoline is hereby incorporated by reference in its entirety. ASTM D7719 is hereby incorporated by reference in its entirety. ASTM D7719 also makes reference to documents not limited to other ASTM specifications, and these references are hereby incorporated by reference in their entirety. ASTM specification D7547 describes a fuel specification for unleaded aviation fuel. ASTM D7547 is hereby incorporated by reference in its entirety. ASTM D7547 also makes reference to documents not limited to other ASTM specifications, and these references are hereby incorporated by reference in their entirety.

ASTM specification D910 entitled "Standard Specification for Aviation Gasolines" describes several characteristics that an aviation gasoline may meet, and it is hereby incorporated by reference in its entirety. ASTM D910 also makes reference to documents not limited to other ASTM specifications, and these references are also hereby incorporated by reference. The ASTM D910 specification describes many requirements, some of which are described briefly below:

- The distillation curve has a 10 vol % maximum fuel evaporation at 75° C.
- The distillation curve has a 40 vol % minimum fuel evaporation at 75° C.
- The distillation curve has a 50 vol % maximum fuel evaporation at 105° C.
- The distillation curve has a 90 vol % maximum fuel evaporation at 135° C.
- The distillation curve has a final boiling point maximum at 170° C.
- The distillation curve has sum of 10%+50% volumes evaporated temperatures at a minimum of 135° C.
- The distillation curve has a recovery volume of 97%
- The distillation curve has a residue volume maximum of 1.5%
- The distillation curve has a maximum loss of 1.5%
- The fuel composition has a freezing point below −58° C.
- The fuel composition has a net heat of combustion of at least 43.5 MJ/kg
- The fuel composition has an appropriate density, for example about 0.74 to 0.76
- The fuel composition has a sulfur content less than 0.05%
- The fuel composition has an oxidation stability of about 6 mg/100 mL
- The fuel composition exhibits corrosion of a copper strip for 2 hours at 100° C. less than the value indicated in ASTM D910
- The fuel composition exhibits a water reaction of less than +/−2 volume changes in mL/100 mL
- The fuel composition exhibits an electrical conductivity of less than 450 pS/m
- The fuel composition exhibits a Reid Vapor Pressure (RVP) between 38 to 49 kPa at 38° C.
- The knock value Motor Octane Number minimum of 99.6
- The supercharge performance MON number minimum 130
- Tetraethyl lead (TEL) maximum content 0.53 mL/L The terms "motor octane number" and "research octane number" are well known in the fuel art. As is further known in the art, aviation fuels are characterized according to the motor octane number (MON); automotive fuels are characterized by MON and, in the United States, the sum of the research octane number (RON) and MON divided by 2, i.e. (RON+MON)/2. As used herein, the term "motor octane number" is referenced to ASTM D2700-09; the term "research octane number" is referenced to ASTM D2699-09. Interestingly, there is no official ASTM measure of burn speed in a combustion engine.

It has been unexpectedly found that fuel compositions comprising alicyclic alkanes, straight or branched chain alkanes and aromatics, for example cyclopentane, isooctane and one or more isomers of xylene, have surprisingly high motor octane number (MON) and a research octane number (RON) than would be expected for this composition.

In certain embodiments, the fuel composition of the present invention may comprise:

- Alicyclic alkanes, straight and/or branched chain alkanes, and at least one aromatic
- Cyclopentane+alkanes (e.g. alkylates)+a range of aromatics (such as toluene, xylenes, trimethylbenzenes, and other C9 aromatics, etc.)
- Cyclopentane+alkanes (e.g. alkylates)+xylenes (mixed xylenes) but preferably meta-xylene (m-xylene with the highest motor octane and the lowest melting point −48 C)
- Cyclopentane+Isooctane+a range of aromatics (like toluene, xylenes, trimethylbenzenes, and other C9 aromatics, etc.)
- Cyclopentane+Isooctane+xylenes (mixed xylenes) but preferably meta-xylene (m-xylene with the highest motor octane and the lowest melting point −48 C)
- Cyclopentane+Isooctane+mesitylene
- Cyclopentane+alkanes (e.g. alkylates)+mesitylene In certain embodiments, an alicyclic alkane is employed in the fuel. Such an alicyclic alkane may contain 3, 4, 5, 6, 7, 8, 9, and/or 10 carbon atoms in the ring. For example, suitable alkanes include cyclopropane, cyclobutane, cyclopentane, cyclohexane, cycloheptane, cyclooctane, cyclononane, and/or cyclodecane. Such cyclic alkanes may contain additional substituents, including, but not limited to linear alkanes, branched alkanes, and/or aromatic groups (phenyl, naphthyl, or other extended aromatic systems).

Such substituents may also comprise alkoxy substituents, including, but not limited to methoxy, ethoxy, propoxy, butoxy, and/or pentoxy substituents. In some embodiments of the present disclosure, cyclopentane is used in compositions of the present invention. For example, in one embodiment cyclopentane is blended so that the final composition comprises from about 1 to about 60 weight percent cyclopentane. In another embodiment, cyclopentane may be present from about 10 to about 50 weight percent cyclopentane. In still another embodiment, cyclopentane may be present from about 20 to about 40 weight percent.

The inventive fuels further comprise at least one straight and/or branched chain alkane. Such alkanes preferably are selected from the group consisting of propane, butane, pentane, hexane, heptane and octane. In certain embodiments the fuel comprises only straight chain alkanes, only branched alkanes, or a combination of straight and branched chain alkanes. In one embodiment, the fuel comprises more than 0 wt % to about 60 wt % of the fuel formulation.

In a preferred embodiment, the fuel comprises isooctane. The term "isooctane" is conventionally recognized in the fuel art and herein to refer to 2,2,4-trimethylpentane. Isooctane is further defined as having a motor octane number of 100. In one embodiment, isooctane comprises from more than 0% to about 60% by weight of the composition. In another embodiment, isooctane is present from about 25 to about 50 weight percent. In still another embodiment, isooctane is present from about 35 to about 40 weight percent.

The fuel further comprises more than 0 wt % to about 50 wt % of at least one aromatic. The at least one aromatic is preferably selected an aromatic including 6 to 9 carbon atoms, particularly from the group consisting of benzene, toluene, xylene and trimethylbenzene.

Xylene exists as three possible isomers, ortho-xylene, meta-xylene, or para-xylene. As used herein, the terms p-xylene and para-xylene are used interchangeably to represent the para-isomer of xylene. The terms m-xylene and meta-xylene are used interchangeably to represent the meta-isomer of xylene. The terms o-xylene and ortho-xylene both refer to the ortho-isomer of xylene.

The xylene used in the present invention may be pure compositions of one isomer or a mixture of isomers. Any individual or mixture of isomers of xylene are generally referred to herein as "xylenes." Embodiments of the present invention may employ xylenes as a fuel additive without limitation as to the isomer(s) and/or quantity of isomers in the xylenes component. In certain embodiments, one or more xylene isomers are present in amounts from more than 0% to about 50% weight of the composition. In another embodiment, one or more xylene isomers may be present from about 20 to about 40 weight percent of the composition. In still another embodiment, one or more xylene isomers is present from about 20 to about 30 weight percent of the composition.

In order to promote a further understanding of the present invention and its various embodiments, the following specific examples are provided. It will be understood that these examples are illustrative and not limiting of the invention.

Example 1

Preparation of a Fuel

Materials and Methods:

A motor fuel was prepared by admixing several components so that the final composition comprised about 41% by weight cyclopentane, about 32% by weight isooctane, and about 27% by weight admixture of xylenes. [Do we have separate #'s?]

Results:

The fuel composition as prepared above exhibited a favorable MON with a very fast burn speed. This MON was surprising and unexpected given the octane numbers (MON and RON) of the components of the mixture. As octane numbers are measurements of a kinetic parameter, this fuel composition may be highly advantageous. This fuel exhibited a density of about 0.74 g/mL. This makes the fuel composition of the present example relatively light compared to other unleaded fuels. A lower density fuel is beneficial for aviation uses in that the fuel has less mass that must be transported per volume of space in the aircraft fuel tank. Also, the fuel met all the requisite criteria of the ASTM D910 and ASTM 7547 specifications with a high-octane result, but without the use of TEL.

Unless otherwise indicated, the phrase "substantially free of" is intended to mean that a particular specified component is not purposely added to the aviation fuel composition. In embodiments, on a weight basis, "substantially free of" means that less than 0.5 wt %; or less than 0.15 wt %; or less than 0.05 wt % of a particular compound is present in the blended gasoline composition. In embodiments, on a volume basis, "substantially free of" means that less than 0.3 vol %; or less than 0.15 vol %; or less than 0.05 vol % of a particular compound is present in the blended aviation gasoline composition.

With respect to tetraethyl lead and other lead-based additives, "substantially free of" is intended to mean that less than 0.1 ml/gallon; or less than 0.05 ml/gallon of tetraethyl lead and/or other lead additives are present in the blended aviation gasoline composition.

With respect to ether compounds, such as MTBE, ethyl t-butyl ether (ETBE) and t-amyl ether (TAME), "substantially free of" is intended to mean that less 0.3 vol %; or less than 0.15 vol %; or less than 0.05 vol % is present in the composition.

The present invention provides a fuel composition possessing a high motor octane number (MON), and suitable as both a motor fuel and an aviation fuel. The fuel composition is substantially free of added lead; in some embodiments is free of lead; and in some embodiments contains no added tetraethyl lead. In embodiments, the aviation fuel composition meets or exceeds the specification of ASTM D910-07a: *Standard Specification for Aviation Gasolines*. In some such embodiments, the aviation fuel composition is suitable as a substitute for Grade 100LL aviation fuel, as outlined by the specification.

In one embodiment, the aviation fuel composition is substantially free of ether compounds, including alkyl tertiary butyl ether compounds, such as methyl tertiary butyl ether or ethyl tertiary butyl ether. In an embodiment, the fuel composition is substantially free of amine compounds, including aliphatic or aromatic amine compounds. In an embodiment, the aviation fuel composition is substantially free of tri-isobutylene and/or other isomers of $C_{12}$ isoparaffins.

The uses of the terms "a" and "an" and "the" and similar references in the context of describing the invention (especially in the context of the following claims) are to be construed to cover both the singular and the plural unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected. In addition, all references cited herein are indicative of the level of skill in the art and are hereby incorporated by reference in their entirety.

What is claimed is:

1. A motor fuel comprising:

20-40 wt % cyclopentane, 35-40 wt % isooctane and 20-30 wt % aromatics, the aromatics being selected from the group consisting of toluene, xylene and trimethylbenzene, the motor fuel comprising less than 0.1 ml/gallon of tetraethyl lead, less than 0.3 vol % of MTBE, less than 0.3 vol % of ETBE and less than 0.3 vol % of TAME, the motor fuel further comprising less than 0.5 wt % aromatic amines.

2. The motor fuel of claim 1 in which said aromatic comprises m-xylene.

3. The motor fuel of claim 2 in which said aromatic further comprises 1,3,5-trimethylbenzene.

4. The motor fuel of claim 1, wherein said motor fuel comprises less than about 0.5 percent by weight of added lead compounds or octane enhancing fuel additives.

5. The motor fuel of claim 1 wherein the motor fuel has a motor octane number greater than 100.

6. The motor fuel of claim 1 consisting essentially of cyclopentane, isooctane and xylene.

7. The motor fuel of claim 6 wherein the motor fuel has a motor octane number greater than 100.

* * * * *